US005378676A

United States Patent [19]

Defieuw et al.

[11] Patent Number: 5,378,676

[45] Date of Patent: Jan. 3, 1995

[54] HEAT-RESISTANT LAYER OF DYE-DONOR ELEMENT

[75] Inventors: Geert Defieuw, Kessel-Lo; Emiel Verdonck, Berlaar; Hendrik Sneyers, Nijlen, all of Belgium

[73] Assignee: AGFA-Gevaert, N.V., Mortsel, Belgium

[21] Appl. No.: 160,849

[22] Filed: Dec. 3, 1993

[30] Foreign Application Priority Data

Dec. 7, 1992 [EP] European Pat. Off. ..... 92203792

[51] Int. Cl.[6] ..... B41M 5/035; B41M 5/38

[52] U.S. Cl. ..... 503/227; 428/206; 428/331; 428/413; 428/913; 428/914

[58] Field of Search ..... 8/471; 428/195, 206, 428/331, 413, 913, 914, 488.4; 503/227

[56] References Cited

FOREIGN PATENT DOCUMENTS 2275777 11/1987 Japan ..... 503/227

*Primary Examiner*—B. Hamilton Hess

*Attorney, Agent, or Firm*—Breiner & Breiner

[57] ABSTRACT

Dye-donor element for use according to thermal dye transfer methods comprising a support having on one side a dye layer and on the other side a heat-resistant layer comprising a binder and inorganic silicate particles, wherein said inorganic silicate particles protrude from the surface of said heat-resistant layer and said binder comprises a polycarbonate derived from a bis-(hydroxyphenyl)-cycloalkane.

10 Claims, No Drawings

HEAT-RESISTANT LAYER OF DYE-DONOR ELEMENT

DESCRIPTION

1. Field of the Invention

The present invention relates to dye-donor elements for use according to thermal dye sublimation transfer and in particular to a heat-resistant layer of said dye-donor elements.

2. Background of the invention

Thermal dye sublimation transfer also called thermal dye diffusion transfer is a recording method in which a dye-donor element provided with a dye layer containing sublimable dyes having heat transferability is brought into contact with a receiver sheet and selectively, in accordance with a pattern information signal, is heated by means of a thermal printing head provided with a plurality of juxtaposed heat-generating resistors, so that dye is transferred from the selectively heated regions of the dye-donor element to the receiver sheet and forms a pattern thereon, the shape and density of which is in accordance with the pattern and intensity of heat applied to the dye-donor element.

A dye-donor element for use according to thermal dye sublimation transfer usually comprises a very thin support e.g. a polyester support, one side of which has been covered with a dye layer comprising the printing dyes. Usually, an adhesive or subbing layer is provided between the support and the dye layer.

Owing to the fact that the thin support softens when heated during the printing operation and then sticks to the thermal printing head, thereby causing malfunction of the printing apparatus and reduction in image quality, the back of the support (the side opposite to that carrying the dye layer) is typically provided with a heat-resistant layer to facilitate passage of the dye-donor element under the thermal printing head. An adhesive layer may be provided between the support and the heat-resistant layer.

The heat-resistant layer generally comprises a lubricant and a binder. In the conventional heat-resistant layers the binder is either a cured binder as described in e.g. EP 153,880, EP 194,106, EP 314,348, EP 329,117, JP 60/151,096, JP 60/229,787, JP 60/229,792, JP 60/229,795, JP 62/48,589, JP 62/212,192, JP 62/259,889, JP 01/5884, JP 01/56,587, and JP 02/128,899 or a polymeric thermoplast as described in e.g. EP 267,469, JP 58/187,396, JP 63/191,678, JP 63/191,679, JP 01/234,292, and JP 02/70,485) .

A disadvantage of cured binders is their cumbersome manufacture requiring relatively long curing times.

Polymeric thermoplasts known for use as binder for the heat-resistant layer such as i.a. poly(styrene-co-acrylonitrile), polystyrene, and polymethyl methacrylate have the disadvantage of having a relatively low glass transition temperature of approximatively 100° C. and thus lead to a relatively low heat-stability of the heat-resistant layer containing said binder and consequently to an unsatisfactory performance of said heat-resistant layer. Further when dye-donor elements having such heat-resistant layers have been rolled up and stored for any length of time such that the back coating of one portion of the dye-donor element is held against the dye layer of another portion, migration of the dye takes place, thus leading to a density loss in prints eventually made by means of that dye-donor element.

Polycarbonates derived from bisphenol A have higher glass transition temperatures. Yet, these polymers are not soluble in ecologically acceptable solvents such as ketones. It is preferred to use ecologically acceptable solvents for the coating solution of the heat-resistant layer.

The polycarbonates described in JP 62/294591 are also not soluble in ecologically acceptable solvents.

The binder of the heat-resistant layer should thus combine a satisfactory thermostability with a good solubility in ecologically acceptable solvents.

Polycarbonates such as those identified in European Patent Application N° 91202071.6 combine an excellent thermostabiiity and solubility without the need for long curing conditions. A problem arises, however, when these polycarbonates are used in a mixture with lubricants such as silicones or in combination with a separate lubricating topcoat such as that mentioned in European Patent Application N° 92200229.0. When such lubricants are incorporated into the heat-resistant layer, only a small portion of these lubricants can enter into direct contact with the thermal printing head, thus leading to ineffective slipping relative to the thermal printing head during printing and occurrence of color drift. This problem can be solved by applying the silicone-based lubricant such as liquid silicone oils and liquid silicone block copolymers e.g. block copolymers of polysiloxan and polyether in the form of a separate topcoat on top of the heat-resistant layer. This improves the slipping properties of the dye-donor element. However, when multiple prints have to be made using high printing energy and without cleaning of the thermal printing head, a residue may form, however, on the heat-generating resistors and, as a consequence, cause malfunction of the printing device and defects such as jamming, scratching of the printed image, and breakdown of the resistors.

SUMMARY OF THE INVENTION

It is therefore an object of the present invention to provide a dye-donor element for use according to thermal dye transfer methods, said element having favourable slipping properties and causing no substantial contamination of the thermal printing head.

It is also an object of the present invention to provide heat-resistant layers comprising a binder combining a satisfactory thermostability with a good solubility in ecologically acceptable solvents.

Further objects will become apparent from the description hereinafter.

According to the present invention a dye-donor element for use according to thermal dye transfer methods is provided, said element comprising a support having on one side a dye layer and on the other side a heat-resistant layer comprising a binder and inorganic silicate particles, wherein said inorganic silicate particles protrude from the surface of said heat-resistant layer and said binder comprises a polycarbonate derived from a bis-(hydroxyphenyl)-cycloalkane corresponding to general formula (I):

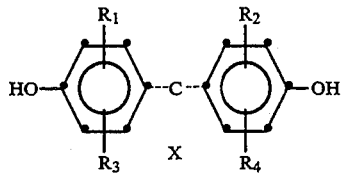

(I)

wherein:

$R^1$, $R^2$, $R^3$, and $R^4$ (same or different) represent hydrogen, halogen, a $C_1$–$C_8$ alkyl group, a substituted $C_1$–$C_8$ alkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group; and X represents the atoms necessary to complete a 5- to 8-membered alicyclic ring, which either carries at least one $C_1$–$C_6$ alkyl group or at least one 5- or 6-membered cycloalkyl group, or carries a fused-on 5- or 6-membered cycloalkyl group.

The present invention further provides a dye-donor element comprising a support having on one side a dye layer and on the other side a heat-resistant layer comprising a binder and inorganic silicate particles and on said heat-resistant layer a topcoat comprising a lubricant e.g. a polydimethylsiloxan-based lubricant, wherein said inorganic silicate particles protrude from the surface of said heat-resistant layer and even from the surface of said topcoat and said binder comprises a polycarbonate derived from a bis-(hydroxyphenyl)-cycloalkane corresponding to the above formula (I).

The present invention further provides a method of forming an image by:

image-wise heating a dye-donor element comprising a support having on one side a dye layer and on the other side a heat-resistant layer comprising a binder and inorganic silicate particles, wherein said inorganic silicate particles protrude from the surface of said heat-resistant layer and said binder comprises a polycarbonate derived from a bis-(hydroxyphenyl)-cycloalkane corresponding to the above general formula (I), and causing transfer of the image-wise heated dye to a receiver sheet.

DETAILED DESCRIPTION OF THE INVENTION

The inorganic silicate particles for use in the heat-resistant layer according to the present invention are salts derived from silica or from the silicic acids.

Preferred representatives for use in accordance with the present invention are i.a. clay, China clay, talc, mica, silica, calcium silicate, aluminium silicate, magnesium silicate, and aluminium magnesium silicate.

The inorganic silicate particles for use according to the present invention may in addition to silicon dioxide comprise other metal oxides such as oxides of e.g. Fe, Mg, Al, K, Na, Ca, Li, Mn, and Cr.

Thanks to the presence of the inorganic silicate particles that protrude from the surface of the heat-resistant layer, the dye-donor element can be used readily for several prints without causing damage or contaminating the thermal printing head. The protruding inorganic silicate particles have a head-cleaning effect on the thermal printing head in that while slipping along the head they remove any foreign substances adhering to the thermal printing head e.g. dust, binder, and releasing agent, and take them away by holding them within the interstitial spaces between the protruding particles. In this way contamination of the thermal printing head by any such foreign substances is avoided.

The head-cleaning effect of the inorganic silicate particles is especially appreciated in cases that the dye-donor element of the invention carries a separate topcoat comprising a lubricant, preferably a polydimethylsiloxan-based lubricant. In such cases all of the lubricant is indeed situated at the surface of the dye-donor element so that high amounts thereof can enter into contact with the thermal printing head and thus improve the slipping contact. Owing to this intense contact with lubricant the thermal printing head would be likely to get contaminated, were it not for the fact that the inorganic silicate particles attend to the head-cleaning effect.

The inorganic silicate particles for use in the heat-resistant layer according to the present invention preferably have an average particle size ranging from 1 to 8 μm and less than 10% by volume of said particles has a size higher than 10 μm. Particles having a size higher than 10 μm cause defects called pinholes. A pinhole is an area that is part of an image area onto which transfer of dye should have occurred but in which said transfer of dye was substantially inhibited owing to the considerable volume and mass of the particles having a size higher than 10 μm. Such large particles obstruct the heat flow, so that the heat generated by the thermal printing head is mainly lost by dissipation and insufficient heat remains for causing the desired transfer of the dye from the dye-donor element to the contacting receiver sheet.

The particle size of the inorganic silicate particles for use in the heat-resistant layer according to the present invention is measured by means of a Coulter Multisizer II having an aperture of 30 μm. A particle having a size of 5 μm (Dynosphere SS-051-P) is used to calibrate the apparatus. The calibration constant is 349.09. The silicate particles are dispersed in an aqueous 0.1N sodium chloride solution comprising a fluorine surfactant before the measurement of the particle size and of the particle size distribution. The measurement is performed for particle sizes ranging from 0.7 to 22.4 μm. The selected siphon mode is 500 μl.

It has been established that talc constitutes preferred inorganic silicate particles. Talc is indeed a relatively soft metal oxide having a Mohs hardness of 1.0 so that it does not abrade: the passivation layer of the thermal printing head. Mostly, organic particles are too soft and consequently have no head-cleaning effect, whereas hard metal oxides such as silica quartz (Mohs hardness: 7) and calcium silicate or wollastonite (Mohs hardness: 4.5) would have an abrasive effect upon the passivation layer of the thermal printing head.

Mixtures of different types of inorganic silicate particles can be used and it is even possible to add restricted amounts of organic particles to said silicate particles.

Examples of talc particles that can be used advantageously in accordance with the present invention are i.a.:

Talc 1: Micro Ace Type P3 having a volume average particle size of 4.5 μm and 1.29% by volume thereof having a size higher than 10 μm (commercially available from Nippon Talc, Interorgana Chemiehandel).

Talc 2: Mistron Ultramix having a volume average particle size of 3.88 μm and 1.72% by volume thereof having a size higher than 10 μm. (commercially available from Cyprus Minerals).

Talc 3: Micro-talc I.T. Extra having a volume average particle size of 4.33 μm and 2.43% by volume thereof having a size higher than 10 μm (commercially available from Norwegian Talc Minerals).

Talc 4: Cyprubond (surface-treated to improve adhesion to the binder) having a volume particle size of 5.28 μm and 9.22% by volume thereof having a size higher than 10 μm (commercially available from Cyprus Minerals).

Talc 5: MP10-52 having a volume particle size of 3.15 μm and 1.26% by volume thereof having a size higher than 10 μm (commercially available from Pfizer Minerals).

Talc 6: MP12-50 having a volume particle size of 2.60 μm and 0.97% by volume thereof having a size higher than 10 μm (commercially available from Pfizer Minerals).

Talc 7: Stellar 600 having a volume average particle size of 5.16 μm and 6.77% by volume thereof having a size higher than 10 μm (commercially available from Norwegian Cyprus Minerals).

Examples of other silicate particles that can be used in accordance with the present invention are i.a.:

Silicate 1: Syloid 378, which are silica particles having an average particle size of 4 μm and 0.06% by volume thereof having a size higher than 10 μm (commercially available from Grace).

Silicate 2: Iriodin 111, which are mica particles having an average particle size of 4.42 μm and 1.45% by volume thereof having a size higher than 10 μm (commercially available from Merck).

Silicate 3: Chlorite, which is a magnesium-aluminium silicate having an average particle size of 5.57 μm and 16.58% by volume thereof having a size higher than 10 μm (commercially available from Cyprus Minerals).

The polycarbonates for use according to the present invention have higher glass transition temperatures (Tg), typically in the range of about 180° C. to about 260° C., than polycarbonates derived from bisphenol A (Tg of about 150° C.). The polycarbonates for use according to the present invention can be homopolycarbonates as well as copolycarbonates. Heat-resistant layers containing polycarbonates derived from bis-(hydroxyphenyl)-cycloalkanes corresponding to general formula I show better heat-stability than heat-resistant layers containing conventional polymeric thermoplasts. Moreover, dye-donor elements containing a heat-resistant layer according to the present invention show good stability when stored in rolled or folded form. Furthermore, the polycarbonates derived from bis-(hydroxyphenyl)-cycloalkanes corresponding to general formula I are soluble in ecologically acceptable solvents such as ethyl methyl ketone and ethyl acetate. As a consequence, heat-resistant layers containing said polycarbonates can be made in a more convenient and ecologically acceptable way than heat-resistant layers containing bisphenol A polycarbonates.

Homopolycarbonates derived from bis-(hydroxyphenyl)-cycloalkanes corresponding to general formula I have a glass transition temperature of 240° C. Homopolycarbonates, the alicyclic ring of which does not carry the above-defined substituents and which consequently do not comply with the above general formula I, have a lower glass transition temperature (typically in the range of about 170° C.). As a consequence, heat-resistant layers containing the latter homopolycarbonates have less heat-stability. Furthermore, such homopolycarbonates are not soluble in the ecologically acceptable solvents ethyl methyl ketone and ethyl acetate.

Likewise, the copolycarbonates derived from bis-(hydroxyphenyl)-cycloalkanes corresponding to general formula I have a glass transition temperature that is higher than that of copolycarbonates, the alicyclic ring of which does not carry the above-defined substituents and which consequently do not comply with the above general formula I.

Preferably one to two carbon atoms of the group of atoms represented by X, more preferably only one carbon atom of that group, carry (carries) two $C_1$–$C_6$ alkyl groups on the same carbon atom. A preferred alkyl group is methyl. Preferably, the carbon atoms of the group of atoms represented by X, which stand in α-position to the diphenyl-substituted carbon atom, do not carry two $C_1$–$C_6$ alkyl groups. Substitution with two $C_1$–$C_6$ alkyl groups is preferred on the carbon atom(s) in β-position to the diphenyl-substituted carbon atom is preferred.

Preferred examples of bis-(hydroxyphenyl)-cycloalkanes corresponding to general formula I, which can be employed for preparing the polycarbonates that can be used according to the present invention are those comprising 5- or 6-membered alicyclic rings. Examples of such bis-(hydroxyphenyl)-cycloalkanes are those corresponding to the following structural formulae II to IV.

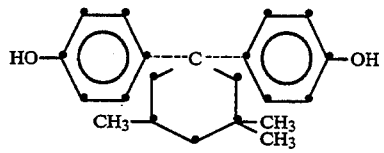

(II)

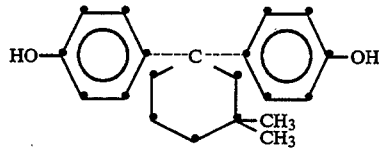

(III)

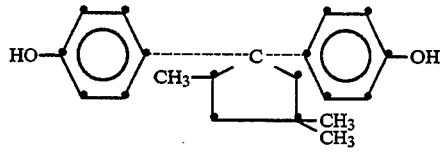

(IV)

A particularly preferred bis-(hydroxyphenyl)-cycloalkane is 1,1-bis-(4-hydroxyphenyl)-3,3,5-trimethylcyclohexane (formula (II)).

The bis-(hydroxyphenyl)-cycloalkanes corresponding to general formula (I) can be prepared according to a known method by condensation of phenols corresponding to general formula (V) and ketones corresponding to general formula (VI):

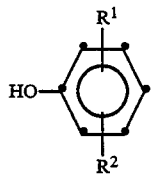

(V)

-continued

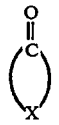

(VI)

wherein $R^1$, $R^2$, and X have the same significances as given to them in general formula (I).

The phenols corresponding to general formula (V) are known compounds or they can be prepared according to known methods (see e.g. for cresols and xylenols in Ullmanns Encyklopädie der technischen Chemie 4. neubearbeitete und erweiterte Auflage, Band 15, pages 61 to 77, Verlag Chemie-Weinheim-New York 1978; for chlorophenols Ullmanns Encyklopädie der technischen Chemie 4. Auflage, Band 9, pages 573. to 582, Verlag Chemie 1975; and for alkylphenols Ullmanns Encyklopädie der technischen Chemie 4. Auflage, Band 18, pages 191 to 214, Verlag Chemie 1979).

Examples of suitable phenols corresponding to general formula (V) are i.a. phenol, o-cresol, m-cresol, 2,6-dimethylphenol, 2-chlorophenol, 3-chlorophenol, 2,6-dichlorophenol, 2-cyclohexylphenol, diphenylphenol, and o- or p-benzylphenol.

Ketones corresponding to general formula (VI) are known compounds; see for e.g. Beilsteins Handbuch der Organischen Chemie, 7. Band, 4. Auflage, Springer-Verlag, Berlin, 1925 and corresponding Ergänzungsbände 1–4; Journal of American Chemical Society, Vol. 79 (1957), pages 1488, 1490 and 1491; U.S. Pat. No. 2,692,289; Journal of Chemical Society, 1954, pages 2186 and 2191; Journal of Organic Chemistry, Vol. 38, No. 26, 1973, page 4431; Journal of American Chemical Society, Vol. 87, 1965, page 1353 (especially page 1355). A general method for preparing ketones corresponding to general formula (VI) has been described in e.g. Organikum, 15. Auflage, 1977, VEB-Deutscher Verlag der Wissenschaften, Berlin, page 698.

Examples of suitable ketones corresponding to general formula (VI) are i.a. 3,3-dimethylcyclopentanone, 2,2-dimethylcyclohexanone, 3,3-dimethylcyclohexanone, 4,4-dimethylcyclohexanone, 3-ethyl-3-methylcyclopentanone, 2,3,3-trimethylcyclopentanone, 2,4,4-trimethylcyclopentanone, 3,3,4-trimethylcyclopentanone, 3,3-dimethylcycloheptanone, 4,4-dimethylcycloheptanone, 3-ethyl-3-methylcyclohexanone, 4-ethyl-4-methylcyclohexanone, 2,3,3-trimethylcyclohexanone, 2,4,4-trimethylcyclohexanone, 3,3,4-trimethylcyclohexanone, 2,5,5-trimethylcyclohexanone, 3,3,5-trimethylcyclohexanone, 3,4,4-trimethylcyclohexanone, 2,3,3,4-tetramethylcyclopentanone, 2,3,4,4-tetramethylcyclopentanone, 3,3,4,4-tetramethylcyclopentanone, 2,2,5-trimethylcycloheptanone, 2,2,6-trimethylcycloheptanone, 2,6,6-trimethylcycloheptanone, 3,3,5-trimethylcycloheptanone, 3,5,5-trimethylcycloheptanone, 5-ethyl-2,5-dimethylcycloheptanone, 2,3,3,5-tetramethylcycloheptanone, 2,3,5,5-tetramethylcycloheptanone, 3,3,5,5-tetramethylcycloheptanone, 4-ethyl-2,3,4-trimethylcyclopentanone, 2-isopropyl-4,4-dimethylcyclopentanone, 4-isopropyl-2,4-dimethylcyclopentanone, 2-ethyl-3,5,5-trimethylcyclohexanone, 3-ethyl-3,5,5-trimethylcyclohexanone, 3-ethyl-4-isopropyl-3-methyl-cyclopentanone, 4-s-butyl-3,3-dimethylcyclopentanone, 2-isopropyl-3,3,4-trimethylcyclopentanone, 3-ethyl-4-isopropyl-3-methyl-cyclohexanone, 4-ethyl-3-isopropyl-4-methylcyclohexanone, 3-s-butyl-4,4-dimethylcyclohexanone, 3-isopropyl-3,5,5-trimethylcyclohexanone, 4-isopropyl-3,5,5-trimethylcyclohexanone, 3,3,5-trimethyl-5-propylcyclohexanone, 3,5,5 -trimethyl-5-propyl-cyclohexanone, 2-butyl-3,3,4-trimethylcyclopentanone, 2-butyl-3,3,4-trimethylcyclohexanone, 4-butyl-3,3,5-trimethylcyclohexanone, 3-isohexyl-3-methylcyclohexanone, 5-ethyl-2,4-diisopropyl-5-methylcyclohexanone, 2,2-dimethylcyclooctanone, and 3,3,8-trimethylcyclo-octanone.

Examples of preferred ketones are:

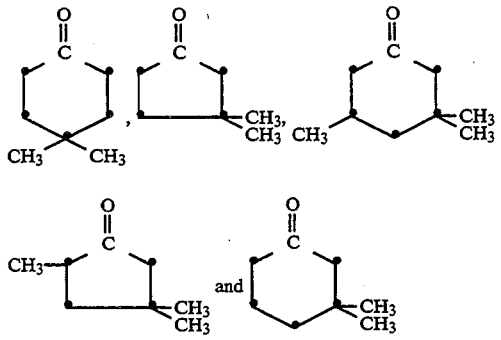

The synthesis of suitable bis-(hydroxyphenyl)-cycloalkanes corresponding to general formula (I) has been described in e.g. DE 3 832 396. The bis-(hydroxyphenyl)-cycloalkanes are used to prepare high molecular weight thermoplastic aromatic polycarbonates for use according to the present invention.

Homopolycarbonates can be prepared from bis-(hydroxyphenyl)-cycloalkanes corresponding to general formula (I), but also copolycarbonates can be prepared by simultaneously using different bis-(hydroxyphenyl)-cycloalkanes, each of which individually corresponds to the general formula (I).

In the preparation of high molecular weight, thermoplastic, aromatic polycarbonates for use according to the present invention the bis-(hydroxyphenyl)-cycloalkanes corresponding to general formula (I) can also be used in combination with other hydroxyphenyl compounds that do not correspond to general formula (I), e.g. with compounds that correspond to the general formula:

HO—Z—OH (VII)

Useful compounds corresponding to general formula (VII) are diphenols, in which Z stands for a bivalent aromatic ring system having from 6 to 30 carbon atoms, which ring system contains at least one aromatic nucleus. The aromatic group Z may carry substituents and may contain aliphatic or alicyclic residues such as the alicyclic residues contained in the bis-(hydroxyphenyl)-cycloalkanes corresponding to general formula (I) or may contain heteroatoms as bond between the separate aromatic nuclei.

Examples of compounds corresponding to general formula (VII) are i.a. hydroquinone, resorcinol, dihydroxydiphenyl, bis-(hydroxyphenyl)-alkanes, bis-(hydroxyphenyl)-cycloalkanes, bis-(hydroxyphenyl)-sulfide, bis-(hydroxyphenyl)-ether, bis-(hydroxyphenyl)-ketone, bis-(hydroxyphenyl)-sulfone, bis-(hydroxyphenyl)-sulfoxide, $\alpha,\alpha'$-bis-(hydroxyphenyl)-diisopropylbenzene, and such compounds carrying at least one alkyl and/or halogen substituent on the aromatic nucleus.

These and other suitable compounds corresponding to general formula (VII) have been described in e.g. U.S. Pat. Nos. 3,028,365, 2,999,835, 3,148,172, 3,275,601, 2,991,273, 3,271,367, 3,062,781, 2,970,131, 2,999,846, DE 1,570,703, DE 2,063,050, DE 2,063,052, DE 2,211,956, FR 1,561,518, and in "Chemistry and Physics of Polycarbonates", Interscience Publishers, New York, 1964.

Other preferred compounds corresponding to general formula (VII) are i.a. 4,4'-dihydroxydiphenyl, 2,2-bis-(4-hydroxyphenyl)-propane, 2,4-bis-(4-hydroxyphenyl)-2-methylbutane, 1,1-bis-(4-hydroxyphenyl)-cyclohexane, α,α'-bis- (4-hydroxyphenyl)-p-diisopropyl-benzene, 2,2-bis-(3-methyl-4-hydroxyphenyl)-propane, 2,2-bis-(3-chloro-4-hydroxyphenyl)-propane, bis-(3,5-dimethyl-4-hydroxyphenyl)-methane, 2,2-bis-(3,5-dimethyl-4-hydroxyphenyl)-propane, bis-(3,5-dimethyl-4-hydroxyphenyl)-sulfone, 2,4-bis-(3,5-dimethyl-4-hydroxy-phenyl)-2-methylbutane, 1,1-bis-(3,5-dimethyl-4-hydroxyphenyl)-cyclohexane, α,α'-bis-(3,5-dimethyl-4-hydroxyphenyl)-p-diisopropylbenzene, 2,2-bis-(3,5-dichloro-4-hydroxyphenyl)-propane, and 2,2-bis-(3,5-dibromo-4-hydroxyphenyl)-propane.

Especially preferred compounds corresponding to general formula (VII) are i.a. 2,2-bis-(4-hydroxyphenyl)-propane, 2,2-bis-(3,5-dimethyl-4-hydroxyphenyl)-propane, 2,2-bis-(3,5-dichloro-4-hydroxyphenyl)-propane, 2,2-bis-(3,5-dibromo-4-hydroxyphenyl)-propane, and 1,1-bis-(4-hydroxyphenyl)-cyclohexane.

Especially preferred is 2,2-bis-(4-hydroxyphenyl)-propane (bisphenol A).

Incorporation of bisphenol A in the polycarbonate for use according to the present invention reduces the brittleness of the polycarbonate. This results in less scratches caused by the contaminated thermal printing head in the transferred image. However, by incorporation of bisphenol A the glass transition temperature is decreased as compared with that of the homopolycarbonate. A compromise has thus to be found between scratching and heat-stability.

At least one compound corresponding to general formula (VII) can be used in combination with bis-(hydroxyphenyl)-cycloalkanes corresponding to general formula (I).

If in the preparation of polycarbonates according to the present invention the bis-(hydroxyphenyl)-cycloalkanes corresponding to general formula (I) are used together with at least one compound corresponding to general formula (VII), the amount of bis-(hydroxyphenyl)-cycloalkanes corresponding to general formula (I) in the mixture is at least 10 mol %, preferably at least 25 mol %.

According to another preferred embodiment the polycarbonate for use according to the present invention is derived from 100 mol % of bis-(hydroxyphenyl)-cycloalkanes corresponding to the above general formula (I).

The high molecular weight polycarbonates can be prepared according to preparation methods for polycarbonates known in the art. The bis-(hydroxyphenyl)-cycloalkane units and the units resulting from the compounds corresponding to general formula (VII) can be present in the polycarbonate in different blocks or the different units can be distributed randomly.

In the preparation of the polycarbonates for use according to the present invention a branching agent may be used. Small amounts, preferably from 0.05 to 2.0 mol % (in respect of the bis-(hydroxyphenyl)-cycloalkane) of tri- or higher functional compounds, in particular compounds having three or more phenolic groups, can be added to obtain branched polycarbonates. Useful branching agents having three or more phenolic groups are i.a. phloroglucinol, 4,6-dimethyl-2,4,6-tri-(4-hydroxyphenyl)-heptene-2, 4,6-dimethyl-2,4,6-tri-(4-hydroxyphenyl)-heptane, 1,3,5-tri-(4-hydroxyphenyl)-benzene, 1,1,1-tri-(4-hydroxyphenyl)-ethane, tri-(4-hydroxyphenyl)-phenylmethane, 2,2-bis-(4,4-bis-(4-hydroxyphenyl)-cyclohexyl)-propane, 2,4-bis- (4-hydroxyphenyl-isopropyl)-phenol, 2,6-bis- (2-hydroxy-5'-methylbenzyl)-4-methylphenol, 2-(4-hydroxyphenyl)-2-(2,4-dihydroxyphenyl)-propane, orthoterephthalic acid hexa-(4-(4-hydroxyphenyl)-isopropyl)-phenyl) ester, tetra-(4-hydroxyphenyl)-methane, tetra-(4-(4-hydroxyphenyl-isopropyl)-phenoxy)-methane, and 1,4-bis-((4'-4''-dihydroxytriphenyl)-methyl)-benzene.

Examples of other trifunctional compounds are i.a. 2,4-dihydroxy-benzoic acid, trimesic acid, cyanuric chloride, and 3,3-bis-(3-methyl-4-hydroxyphenyl)-2-oxo-2,3-dihydroindole.

For terminating the chain elongation and controlling the molecular weight of the polycarbonate use can be made of monofunctional compounds known in the art. They are used in the known concentrations. Suitable compounds are e.g. phenol, t-butylphenol, and other $C_1$–$C_7$-alkyl-substituted phenols. Particularly small amounts of phenols corresponding to the following general formula (VIII) are useful in this respect:

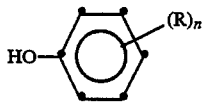

(VIII)

wherein:

R represents at least one substituent chosen from branched $C_8$-alkyl groups and branched $C_9$-alkyl groups, and n is 1, 2, 3, 4, or 5; in case n is 2 to 5 the R groups may have a same or different significance.

Preferably the contribution of $CH_3$-protons in the alkyl group(s) R is between 47 and 89% and the contribution of CH— and $CH_2$-protons is between 53 and 11%. Preferably, the alkyl group(s) R is (are) situated in o- and/or p-position with respect to the OH-group, and in particular the ortho substitution amounts to at the most 20%. The compounds used to terminate the chain elongation are in general used in concentrations of 0.5 to 10, preferably 1.5 to 8 mol % with respect to the content of the bis-(hydroxyphenyl)-cycloalkanes corresponding to general formula (I).

The polycarbonates for use according to the present invention can be prepared according to the interfacial polycondensation method as known in the art (see H. Schnell, "Chemistry and Physics of Polycarbonates", Polymer Reviews, Vol. IX, page 33, Interscience Publ., 1964). According to this method the bis-(hydroxyphenyl)-cycloalkanes are dissolved in aqueous alkaline phase. For the preparation of copolycarbonates mixtures of bis-(hydroxyphenyl)-cycloalkanes corresponding to general formula (I) and other diphenols are used. In order to control the molecular weight compounds terminating the chain elongation can be added (e.g. compounds corresponding to the general formula VIII). The condensation reaction takes place in the presence of an inert organic phase containing phosgene. Preferably, the organic phase that is used is an organic phase capable of dissolving polycarbonate. The reaction temperature is between 0° C. and 40° C.

If branching agents are used, they can be added in an amount of 0.05 to 2 mol % to the aqueous alkaline phase together with the bis-(hydroxyphenyl)-cycloalkanes and other diphenols or they can be added to the organic phase before phosgenation takes place.

In addition to the bis-(hydroxyphenyl)-cycloalkanes and other diphenols also their mono- and/or bis-chlorocarbonate esters can be used, added in the form of a solution in an organic solvent. The amount of chain-terminating agent and branching agent is then levelled against the amount of bis-(hydroxyphenyl)-cycloalkane and other diphenol structural units. When chlorocarbonate esters are used, the amount of phosgene can be reduced as known in the art.

Suitable organic solvents for dissolving the chain-terminating agent, the branching agent, and the chlorocarbonate ester are e.g. methylene chloride, chlorobenzene, acetone, acetonitrile, and mixtures of these solvents, in particular mixtures of methylene chloride and chlorobenzene. Optionally, the chain-terminating agent and the branching agent are dissolved in the same solvent.

As organic phase for the interfacial condensation are used e.g. methylene chloride, chlorobenzene and mixtures of methylene chloride and chlorobenzene.

As aqueous alkaline phase are used e.g. aqueous sodium hydroxide solutions.

The preparation of polycarbonates according to the interfacial polycondensation method can be catalyzed as known in the art by adding catalysts such as tertiary amines, in particular tertiary aliphatic amines such as tributylamine or triethylamine; the catalysts are used in amounts of from 0.05 to 10 mol % in respect of the content of bis-(hydroxyphenyl)-cycloalkanes and other diphenols. The catalysts can be added before the start of the phosgenation, during the phosgenation, or after the phosgenation.

The isolation of the polycarbonates is performed as known in the art.

The polycarbonates for use according to the present invention can also be prepared in homogeneous phase according to a known method (the so-called pyridine method) or according to the known melt ester-interchange process by using e.g. diphenyl carbonate instead of phosgene. In this case as well, the polycarbonates are isolated according to methods known in the art.

Preferably, the molecular weight of the polycarbonates is at least 8000, preferably from 8000 to 200,000 and more preferably from 10,000 to 80,000.

Polycarbonates derived from bis-(hydroxyphenyl)-cycloalkanes corresponding to formula (I) are used as binder in the heat-resistant layer of the dye-donor element according to the present invention in an amount of at least 10% by weight, preferably in an amount from 30 to 100% by weight. A mixture of two or more of said polycarbonates can also be used in the heat-resistant layer.

Examples of polycarbonates that can be used advantageously in accordance with the present invention are i.a.:

PC1 Homopolycarbonate having the following structure:

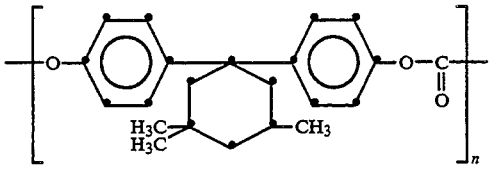

wherein n has a value giving a relative viscosity of 1.295 measured in a 0.5% by weight solution in dichloromethane.

PC2 Homopolycarbonate having the same structure as PC1 but having a relative viscosity of 2.2 measured in a 0.5% by weight solution in dichloromethane.

PC3 Copolycarbonate having the following structure:

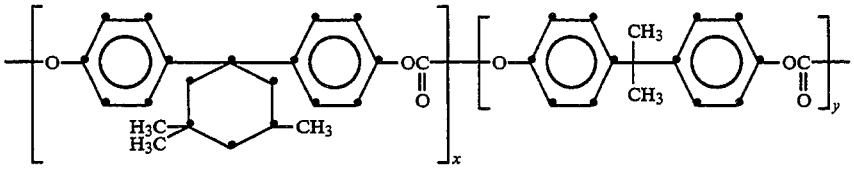

wherein x=55 mol % and y=45 mol %; PC3 has a relative viscosity of 1,295 measured in a 0.5$\mu$ by weight solution in dichloromethane.

The heat-resistant layer of the dye-donor element according to the present invention may in addition to said polycarbonates also contain one or more of the thermoplastic binders commonly used for heat-resistant layers such as e.g. poly(styrene-co-acrylonitrile), poly(vinyl alcohol-co-butyral), poly(vinyl alcohol-co-acetal), poly(vinyl alcohol-co-benzal), polystyrene, poly(vinyl acetate), cellulose nitrate, cellulose acetate propionate, cellulose acetate hydrogen phthalate, cellulose acetate, cellulose acetate butyrate, cellulose triacetate, ethyl cellulose, poly(methyl methacrylate), and copolymers of methyl methacrylate. Poly(styrene-co-acryionitrile) is preferred.

The amount of inorganic silicate particles used in the heat-resistant layer generally is in the range of from about 0.1 to 50 wt %, preferably 0.25 to 40 wt % of the binder or binder mixture employed.

The heat-resistant layer of the dye-donor element according to the present invention may in addition to the inorganic silicate particles comprise minor amounts of such other agents like surface-active agents, liquid lubricants, solid lubricants, or mixtures thereof.

The heat-resistant layer according to the present invention may contain other additives provided such materials do not inhibit the anti-sticking properties of the heat-resistant layer and provided that such materials do not scratch, erode, contaminate, or otherwise damage the thermal printing head or harm image quality. Examples of suitable additives have been described in EP 389,153.

Polydimethylsesquioxan particles can also be incorporated into the heat-resistant layer of the dye-donor element. Examples of such particles are Tospearl 108, Tospearl 120, Tospearl 130, Tospearl 145, and Tospearl 240 (General Electric). These particles increase the stability of the dye-donor element in rolled-up state and yet do not cause contamination of the thermal printing head.

Although these particles can be employed alone they are preferably employed in combination with the inorganic silicate particles used according to the present invention. A combination of a polycarbonate used according to the present invention with polydimethylsesquioxan particles is highly preferred since it facilitates the production of the dye-donor element. No cross-linking of the heat-resistant layer is required. In rolled-up state the dye-donor element remains stable. The thermal stability of the dye-donor element is high.

The heat-resistant layer of the dye-donor element according to the present invention is formed preferably by adding the polymeric thermoplastic binder or binder mixture, the inorganic silicate particles, and other optional components to a suitable solvent or solvent mixture, dissolving or dispersing the ingredients to form a coating composition, applying said coating composition to a support, which may have been provided first with an adhesive or subbing layer, and drying the resulting layer.

The heat-resistant layer of the dye-donor element may be coated on the support or printed thereon by a printing technique such as a gravure process.

The heat-resistant layer thus formed has a thickness of about 0.1 to 3 μm, preferably 0.3 to 1.5 μm.

Preferably a subbing layer is provided between the support and the heat-resistant layer to promote the adhesion between the support and the heat-resistant layer. As subbing layer any of the subbing layers known in the art for dye-donor elements can be used. Suitable binders that can be used for the subbing layer can be chosen from the classes of polyester resins, polyurethane resins, polyester urethane resins, modified dextrans, modified cellulose, and copolymers comprising recurring units such as i.a. vinyl chloride, vinylidene chloride, vinyl acetate, acrylonitrile, methacrylate, acrylate, butadiene, and styrene (e.g. poly(vinylidene chloride-co-acrylonitrile). Suitable subbing layers have been described in e.g. EP 138,483, EP 227,090, European Patent Application N° 92200907.1, U.S. Pat. Nos. 4,567,113, 4,572,860, 4,717,711, 4,559,273, 4,695,288, 4,727,057, 4,737,486, 4,965,239, 4,753,921, 4,895,830, 4,929,592, 4,748,150, 4,965,238, and U.S. Pat. No. 4,965,241. Preferably the subbing layer further comprises an aromatic polyol such as e.g. 1,2-dihydroxybenzene as described in EP 433,496.

Instead of incorporating the inorganic silicate particles in the heat-resistant layer, they can be incorporated at least partially into a said subbing layer between the support and said heat-resistant layer.

In case the heat-resistant layer is covered with a topcoat, the inorganic silicate particles incorporated into said heat-resistant layer and/or into a said underlying subbing layer should still protrude from the surface of said topcoat so that the sliding contact between the dye-donor element and the thermal printing head is substantially accomplished by means of the top of said silicate particles. If these conditions are met, a said topcoat may comprise a polydimethylsiloxan-based lubricant such as those mentioned in the European Patent Application N° 92200229.0. Preferred lubricants derived from polydimethylsiloxan are e.g. Byk 070, Byk 306, Byk 307, Byk 310, Byk 320, and Byk 322, which are commercially available from Byk Cera, The Netherlands, Tegoglide 410, Tegomer A SI 2120, and Tegomer H SI 2311, which are commercially available from Goldschmidt, Germany, and PS 368.5 and PS 363.5, which are commercially available from Petrarch Systems.

Preferably, these silicone compounds for forming a topcoat are coated in the form of a solution in a non-solvent for the polycarbonate of the heat-resistant layer e.g. in isopropanol or a $C_6$–$C_{11}$ alkane.

It is also possible—provided that only or mainly the silicate particles can enter into contact with the thermal printing head—to incorporate silicone compounds into the heat-resistant layer. Yet, the application of a separate topcoat comprising at least one polydimethylsiloxan-based lubricant is preferred.

Any dye can be used in the dye layer of the dye-donor element of the present invention provided it is transferable to the receiver sheet by the action of heat. Examples of suitable dyes have been described in e.g. EP 432,829, EP 400,706, European Patent Application No. 90203014.7, European Patent Application No. 91200218.5, European Patent Application No. 91200791.1, and in the references mentioned therein.

The amount ratio of dye or dye mixture to binder generally ranges from 9:1 and 1:3 by weight, preferably from 3:1 and 1:2 by weight.

The following polymers can be used as polymeric binder: cellulose derivatives, such as ethyl cellulose, hydroxyethyl cellulose, ethylhydroxy cellulose, ethylhydroxyethyl cellulose, hydroxypropyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such. as polyacrylic acid, polymethyl methacrylate and styrene-acrylate copolymers; polyester resins; polycarbonates; copoly(styrene/acrylonitrile); polysulfones; polyphenylene oxide; organosilicones, such as polysiloxans; epoxy resins and natural resins, such as gum arabic. Preferably, the binder for the dye layer of the present invention comprises copoly(styrene/acrylonitrile).

The dye layer may also contain other additives such as i.a. thermal solvents, stabilizers, curing agents, preservatives, organic or inorganic fine particles, dispersing agents, antistatic agents, defoaming agents, and viscosity-controlling agents, these and other ingredients being described more fully in EP 133,011, EP 133,012, EP 111,004, and EP 279,467.

Addition of beads of polyolefin waxes or amid waxes, and/or of polydimethylsesquioxan particles, as described in European Patent Application No. 92203496.2, to the heat-resistant layer, said beads and/or particles protruding from the surface of said layer, is especially preferred.

Any material can be used as the support for the dye-donor element provided it is dimensionally stable and capable of withstanding the temperatures involved, up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyoiefins, polyimides, glassine paper and condenser paper. Preference is given to a support comprising polyethylene terephthalate. In general, the support has a thickness of 2 to 30 μm. The support may also be coated with an adhesive of subbing layer, if desired. Examples of suitable subbing layers have been described in e.g. EP 433,496, EP 311,841, EP 268,179, U.S. Pat. No. 4,727,057, and U.S. Pat. No. 4,695,288.

A dye-barrier layer comprising a hydrophilic polymer may also be employed between the support and the dye layer of the dye-donor element to enhance the dye transfer densities by preventing wrong-way transfer of dye backwards to the support. The dye barrier layer may contain any hydrophilic material that is useful for the intended purpose. In general, good results have been obtained with gelatin, polyacrylamide, polyisopropylacrylamide, butyl methacrylate-grafted gelatin, ethyl methacrylate-grafted gelatin, ethyl acrylate-grafted gelatin, cellulose monoacetate, methyl cellulose, polyvinyl alcohol, polyethyleneimine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable dye barrier layers have been described in e.g. EP 227,091 and EP 228,065. Certain hydrophilic polymers e.g. those described in EP 227,091 also have an adequate adhesion to the support and the dye layer so that the need for a separate adhesive or subbing layer is avoided. These particular hydrophilic polymers used in a single layer in the dye-donor element thus perform a dual function, hence are referred to as dye-barrier/subbing layers.

The support for the receiver sheet that is used with the dye-donor element may be a transparent film of e.g. polyethylene terephthalate, a polyether sulfone, a polyimide, a cellulose ester, or a polyvinyl alcohol-co-acetal. The support may also be a reflective one such as a baryta-coated paper, polyethylene-coated paper or white polyester i.e. white-pigmented polyester. Blue-coloured polyethylene terephthalate film can also be used as support.

To avoid poor adsorption of the transferred dye to the support of the receiver sheet this support must be coated with a special layer called dye-image-receiving layer, into which the dye can diffuse more readily. The dye-image-receiving layer may comprise e.g. a polycarbonate, a polyurethane, a polyester, a polyamide, polyvinyl chloride, polystyrene-co-arcylonitrile, polycaprolactone, or mixtures thereof. The dye-image receiving layer may also comprise a heat-cured product of poly(vinyl chloride/co-vinyl acetate/co-vinyl alcohol) and polyisocyanate. Suitable dye-image-receiving layers have been described in e.g. EP 133,011, EP 133,012, EP 144,247, EP 227,094, and EP 228,066.

In order to improve the light resistance and other stabilities of recorded images, UV absorbers, singlet oxygen quenchers such as HALS-compounds (Hindered Amine Light Stabilizers) and/or antioxidants may be incorporated into the dye-image-receiving layer.

The dye layer of the dye-donor element or the dye-image-receiving layer of the receiver sheet may also contain a releasing agent that aids in separating the dye-donor element from the receiver sheet after transfer. The releasing agents can also be applied in a separate layer on at least part of the dye layer or of the dye-image-receiving layer. Suitable releasing agents are solid waxes, fluorine- or phosphate-containing surfactants and silicone oils. Suitable releasing agents have been described in e.g. EP 133,012, JP 85/19,138, and EP 227,092.

The dye-donor elements according to the invention are used to form a dye transfer image, which process comprises placing the dye layer of the dye-donor element in face-to-face relation with the dye-image-receiving layer of the receiver sheet and image-wise heating from the back of the dye-donor element. The transfer of the dye is accomplished by heating for about several milliseconds at a temperature of 400° C.

When the process is performed for but one single colour, a monochromic dye transfer image is obtained. A multicolour image can be obtained by using a dye-donor element containing three or more primary colour dyes and sequentially performing the process steps described above for each colour. The above sandwich of dye-donor element and receiver sheet is formed on three occasions during the time when heat is applied by the thermal printing head. After the first dye has been transferred, the elements are peeled apart. A second dye-donor element (or another area of the dye-donor element with a different dye area) is then brought in register with the dye-receiving element and the process is repeated. The third colour and optionally further colours are obtained in the same manner.

The following example illustrates the invention in more detail without, however, limiting the scope thereof.

EXAMPLE

A series of dye-donor elements for use according to thermal dye sublimation transfer were prepared as follows.

Polyethylene terephthalate film having a thickness of 6 μm was provided on both sides with a subbing layer from a solution of copolyester comprising isophthalic acid units/terephthalic acid units/ethylene glycol units/neopentyl glycol units/adipic acid units/glycerol units in ethyl methyl ketone.

A solution comprising 4.5% by weight of dye A, 4% by weight of dye B, 3% by weight of dye C, 4% by weight of dye D, 2% by weight of dye E, 8% by weight of poly(styrene-co-acrylonitrile) as binder, and 1% by weight of the amide wax Ceridust 3910 (commercially available from Hoechst, Germany) in ethyl methyl ketone as solvent was prepared:

A

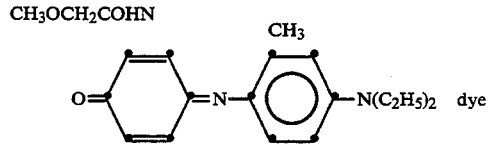

-continued

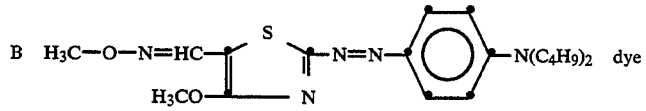

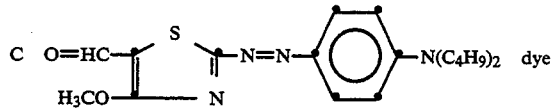

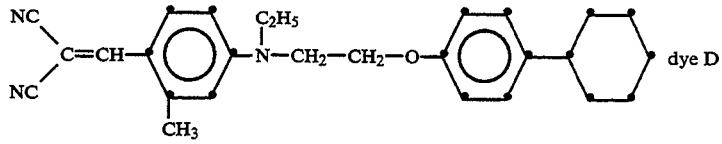

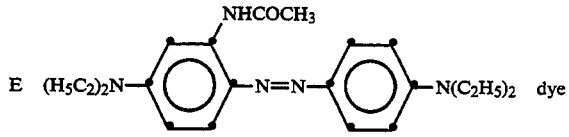

From the resulting solution a layer having a wet thickness of 10 μm was coated on the subbed polyethylene terephthalate film. The resulting dye layer was dried by evaporation of the solvent.

A heat-resistant layer having a wet thickness of 10 μm was coated on the subbed back of the polyethylene terephthalate film from a solution in ethyl methyl ketone containing a polycarbonate binder (the nature and amount of which are indicated below in Table 1) and silicate particles (the nature and amount of which are also indicated in Table 1).

As can be derived from Table 1, the thus obtained dye-donor elements were coated on the side showing the heat-resistant layer with a solution forming a topcoat (Topcoat I), said solution being a 0.5% by weight solution of Tegoglide 410 (commercially available from Goldschmidt) in isopropanol.

Another sample of the dye-donor elements obtained as described above was coated on the side showing the heat-resistant layer with a solution forming a topcoat (Topcoat II), said solution being a 0.5% by weight solution of Byk 320 (commercially available from Byk Cera, The Netherlands) in Exxsol DSP 80/110 naphtha (commercially available from Exxon), which naphtha is a mixture of paraffins and in which the content of aromatics has been reduced.

A further sample of the dye-donor elements obtained as described above was coated on the side showing the heat-resistant layer with a solution forming a topcoat (Topcoat III), said solution being a 0.5% by weight solution of Byk 322 (commercially available from Byk Cera, The Netherlands) in the above-defined Exxsol DSP 80/110 naphtha.

Receiver sheets were prepared by coating a polyethylene terephthalate film support having a thickness of 175 μm. with a dye-image-receiving layer from a solution in ethyl methyl ketone of 3,6 g/m$^2$ of poly(vinyl chloride/co-vinyl acetate/co-vinyl alcohol) (Vinylite VAGD supplied by Union Carbide), 0,336 g/m$^2$ of diisocyanate (Desmodur N3300 supplied by Bayer AG), and 0,2 g/m$^2$ of hydroxy-modified polydimethylsiloxan (Tegomer H SI 2111 supplied by Goldschmidt).

Each dye-donor element was printed in combination with a receiver sheet in a printer set-up using a Kyocera thermal printing head, Type KGT-219-12MP4-75PM, at a voltage of 13.5 V (DIN A4 prints). The printing was repeated 25 times for each dye-donor element. All heat-resistant layers as identified in Table 1 hereinafter allowed easy continuous transport across the thermal printing head. Next, the thermal printing head was disconnected from the printer and inspected under an optical microscope (Leitz microscope: enlargement 100x) to trace any contamination of the resistors of the thermal printing head. The following levels of contamination were attributable: excellent (no contamination at all), good (hardly perceptible contamination), moderate (clearly visible contamination), and bad (extensive contamination all over the electrode surfaces).

After printing the receiver sheets were separated from the dye-donor elements.

Any possible presence of pinholes in the transferred image was checked visually and given an evaluation level chosen from excellent (no pinholes at all), good (very few or almost invisible pinholes), moderate (clearly visible pinholes disturbing the image quality), and bad (high number of pinholes rendering the transferred image illegible).

In Table 1 hereinafter (E) stands for excellent, (G) for good, (M) for moderate, and (B) for bad. The amounts of the silicate particles and binder are indicated in % by weight calculated on the total weight of the coating solution (solvent was added up to 100%). The results obtained are listed in the Table.

TABLE 1

| Heat-resistant layer | | | | Top- | Pin- | Contam- |
|---|---|---|---|---|---|---|
| Silicate | % (wt) | Binder | % (wt) | coat | holes | ination |
| None | (comparison) | PC1 | 13 | I | E | B |
| Talc 1 | 0.50 | PC1 | 13 | I | E | G |
| Talc 1 | 0.50 | PC2 | 06 | I | E | G |
| Talc 1 | 0.50 | PC3 | 13 | I | E | G |
| Talc 2 | 0.50 | PC1 | 13 | I | E | G |
| Talc 3 | 0.50 | PC1 | 13 | I | E | G |
| Talc 4 | 0.50 | PC1 | 13 | I | G | E |
| Silicate 1 | 0.25 | PC1 | 13 | I | E | G |
| Silicate 2 | 0.50 | PC1 | 13 | I | E | E |
| Silicate 3 | 0.50 | PC1 | 13 | I | G | E |
| Talc 1 | 0.50 | PC1 | 13 | II | E | G |

TABLE 1-continued

| Heat-resistant layer | | | | Top- | Pin- | Contam- |
|---|---|---|---|---|---|---|
| Silicate | % (wt) | Binder | % (wt) | coat | holes | ination |
| Talc 1 | 0.50 | PC1 | 13 | III | E | G |

The above results show that when a polycarbonate according to the present invention is used as binder for the heat-resistant layer in combination with inorganic silicate particles protruding from the surface of the heat-resistant layer, a dye-donor element is obtained, which has a favourable heat-stability, offers good image quality, and causes no contamination of the thermal printing head. It was also experienced that a low number of particles sizing more than 10 μm resulted in a low number of pinholes in the printed image.

We claim:

1. Dye-donor element for use according to thermal dye transfer methods, said element comprising a support having on one side a dye layer and on the other side a heat-resistant layer comprising a binder and inorganic silicate particles, wherein said inorganic silicate particles protrude from the surface of said heat-resistant layer and said binder comprises a polycarbonate derived from a bis-(hydroxyphenyl)-cycloalkane corresponding to general formula (I):

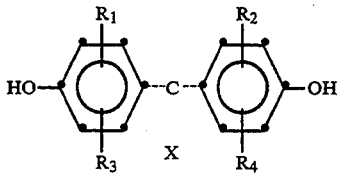

(I)

wherein:

$R^1$, $R^2$, $R^3$, and $R^4$ same or different represent hydrogen, halogen, a $C_1$–$C_8$ alkyl group, a substituted $C_1$–$C_8$ alkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group; and X represents the atoms necessary to complete a 5- to 8-membered alicyclic ring, which either carries at least one $C_1$–$C_6$alkyl group or at least one 5- or 6-membered cycloalkyl group, or carries a fused-on 5- or 6-membered cycloalkyl group.

2. A dye-donor element according to claim 1, wherein said 5- to 8-membered alicyclic ring carries two $C_1$–$C_6$ alkyl groups on the carbon atom(s) in β-position to the diphenyl-substituted carbon atom.

3. A dye-donor element according to claim 1 or 2, wherein the bis-(hydroxyphenyl)-cycloalkane corresponding to general formula (I) is 1,1-bis-(4-hydroxyphenyl)-3,3,5-trimethylcyclohexane.

4. A dye-donor element according to claim 1, wherein said polycarbonate is a homopolycarbonate.

5. A dye-donor element according to claim 1, wherein said polycarbonate is derived from a bis-(hydroxyphenyl)-cycloalkane corresponding to general formula (I) and a diphenol corresponding to general formula (VII):

HO—Z—OH (VII)

wherein Z stands for a bivalent aromatic ring system having from 6 to 30 carbon atoms, which ring system contains at least one aromatic nucleus.

6. A dye-donor element according to claim 1, wherein said inorganic silicate particles are selected from the group consisting of clay, China clay, talc, mica, silica, calcium silicate, aluminium silicate, magnesium silicate, and aluminium magnesium silicate.

7. A dye-donor element according to claim 1, wherein said inorganic silicate particles have an average particle size ranging from 1 to 8 μm and less than 10% by volume of said particles has a size higher than 10 μm.

8. Dye-donor element comprising a support having on one side a dye layer and on the other side a heat-resistant layer comprising a binder and inorganic silicate particles and on said heat-resistant layer a topcoat comprising a lubricant, wherein said inorganic silicate particles protrude from the surface of said heat-resistant layer and said topcoat and said binder comprises a polycarbonate derived from a bis-(hydroxyphenyl)-cycloalkane corresponding to the general formula (I) of claim 1.

9. A dye-donor element according to claim 8, wherein said lubricant is a polydimethylsiloxane-based lubricant.

10. Method for forming an image by:

image-wise heating a dye-donor element comprising a support having on one side a dye layer and on the other side a heat-resistant layer comprising a binder and inorganic silicate particles, wherein said inorganic silicate particles protrude from the surface of said heat-resistant layer and said binder comprises a polycarbonate derived from a bis-(hydroxyphenyl)-cycloalkane corresponding to the general formula (I):

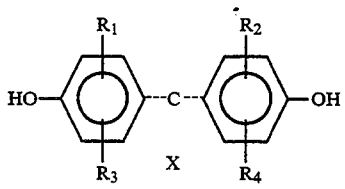

(I)

wherein:

$R^1$, $R^2$, $R^3$, and $R^4$ same or different represent hydrogen, halogen, a $C_1$–$C_8$ alkyl group, a substituted $C_1$–$C_8$ alkly group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group, and X represents the atoms necessary to complete a 5- to 8-membered alicyclic ring, which either carries at least one $C_1$–$C_6$ alkyl group or at least one 5- or 6-membered cycloalkyl group, or carries a fused-on 5- or 6-membered cycloalkyl group; and causing transfer of the image-wise heated dye to a receiver sheet.

* * * * *